United States Patent [19]

McCauley Leo P.

[11] Patent Number: 4,809,787

[45] Date of Patent: Mar. 7, 1989

[54] METHOD AND APPARATUS FOR REMOVING ACCUMULATED ICE FROM PAVEMENT

[76] Inventor: McCauley Leo P., Box 91783, Anchorage, Ak. 99509

[21] Appl. No.: 147,861

[22] Filed: Jan. 25, 1988

[51] Int. Cl.[4] ..... B25D 17/06

[52] U.S. Cl. ..... 173/1; 173/90; 173/128

[58] Field of Search ..... 173/1, 29, 90, 171, 173/128–132; 37/196, 197, 117.5, DIG. 18; 404/90; 299/24

[56] References Cited

U.S. PATENT DOCUMENTS 4,439,056 3/1984 Reilly et al. ..... 173/90 X 4,511,282 4/1985 Gurries ..... 404/90

4,634,311 1/1987 Jannings et al. ..... 404/90

*Primary Examiner*—Donald R. Schran

*Assistant Examiner*—James L. Wolfe

[57] ABSTRACT

An ice breaking attachment for impact hammers. The main component is a rigid metal beam used to transfer the blows of the impact hammer to the ice surface and then when the beam breaks through the ice distribute the impact of those blows over a large enough area to prevent damaging the underlying surface. The beam has a convex lower edge that also helps prevent damage to the underlying pavement. A vertical metal sleeve welded at the center of the beam accepts the blunt end of the impact hammer bit, and tether cables or chains attach the apparatus to the frame of the impact hammer.

2 Claims, 2 Drawing Sheets

METHOD AND APPARATUS FOR REMOVING ACCUMULATED ICE FROM PAVEMENT

BACKGROUND OF INVENTION

1. Field of Invention

The present invention generally relates to removing ice and hard-packed snow that has accumulated and frozen on paved surfaces, without damaging the paved surface.

2. Description of Prior Art

With the growing density of population in cold climates, the problems of ice accumulations on surfaces installed for human traffic have become more severe. In some areas ice accumulations of four to six inches on sidewalks, driveways, parking lots, and streets are not uncommon by mid-winter.

Current methods of dealing with ice fall into two categories that are often used in conjunction. The first category concerns chemical treatment of ice to promote melting. This method is very effective if conditions are conducive. However, if there is not adequate drainage or appropriate conditions or fast evaporation, the melted ice will usually dilute, refreeze, and still present the same problems. Some chemicals do not melt ice when temperatures drop below a certain point, and if there is already a substantial accumulation of ice, the amount of chemicals needed and their costs become prohibitive.

The other category concerns physical removal of ice. The simplest method is by manually chipping the ice with some type of hand held tool. This method is very labor intensive and the underlying surface is often chipped in the process. At the other end of the scale is the use of very heavy equipment using ice blades to scrape and cut the ice. This method is effective on streets and large parking lots where large, heavy equipment can maneuver. In many cases the equipment is powerful enough to damage the underlying surface if great care is not taken.

There ar a great variety of paved areas that are not easily serviced by any of these methods.

SUMMARY OF THE INVENTION

It is the aim of this invention, therefore, to provde an effective method and apparatus for removing accumulated ice from paved surfaces where neither chemical, nor small or large scale physical methods are practical. It is a further aim of this invention to provide a method and apparatus for removing the ice without damaging the underlying surface.

The present invention consists basically of a metal beam attachment to be used in conjunction with any commercially available impact hammer. This combination is used to fracture and break up ice accumulations on paved surfaces. The length and shape of the beam attachment prevent damage to the underlying surface.

BRIEF DESCRIPTION OF THE DRAWINGS

FIG. 3 and FIG. 4 show two types of equipment the ice breaker and impact hammer can be mounted on.

DESCRIPTION OF THE ILLUSTRATED EMBODIMENTS

Figure 1:
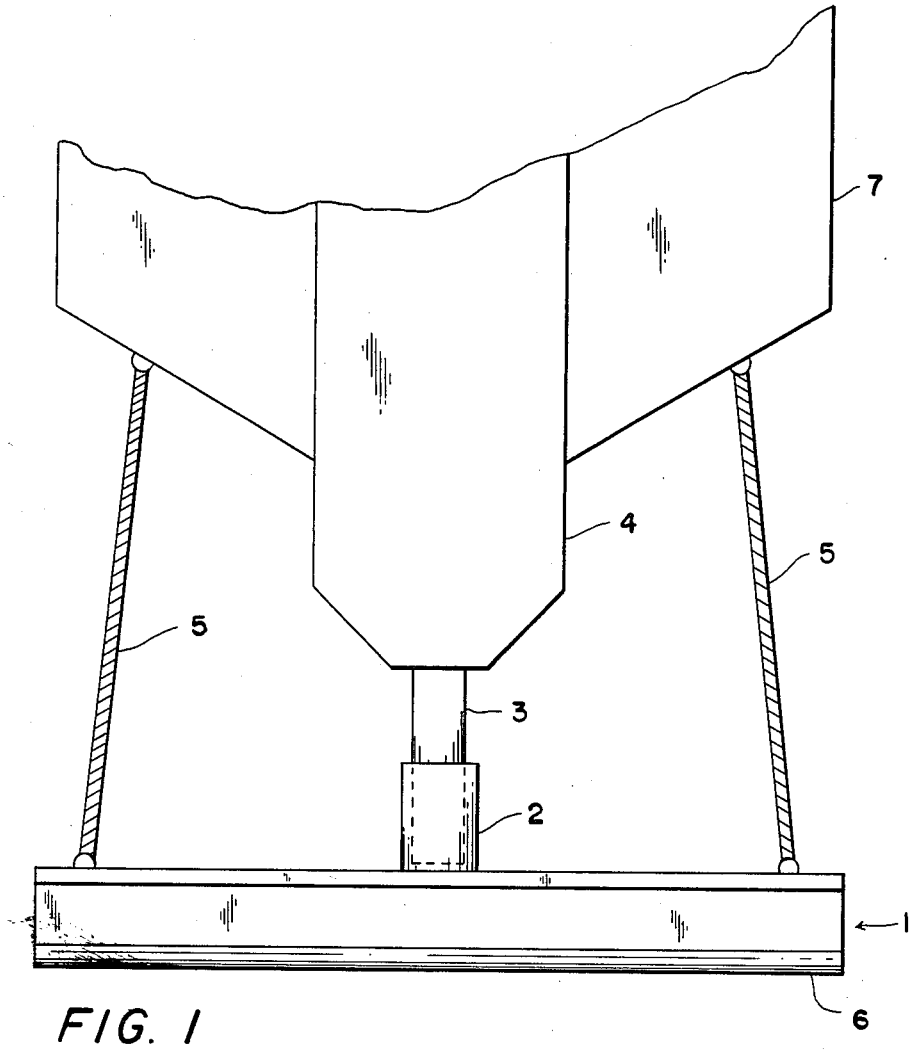
FIG. 1 is a front elevation showing the ice breaker apparatus of the present invention attached to an impact hammer.

As shown in the drawing, the apparatus of the present invention consists of a length of metal beam 1 with a vertical sleeve 2 welded to the beam at the center of its length. A blunt bit 3 of an impact hammer 4 is inserted into the vertical sleeve 2 so as to impact the center of the beam 1. The length of the beam 1 is determined by the size and weight of the impact hammer and the equipment to which it is attached. It must be of sufficient length to distribute the blows of the impact hammer to such a degree that it will not damage the underlying surface 9 after breaking through the brittle ice 8. The brittleness of the ice compared to the toughness of the underlying pavement makes this possible. The beam 1 is attached to the main frame 7 of the impact hammer by two tether cables or chains 5. This holds the blunt bit 3 in its sleeve 2 when the unit is moved across the ice surface. Enough slack must be left in these tethers to prevent them from taking the impact of the hammer.

Figure 2:
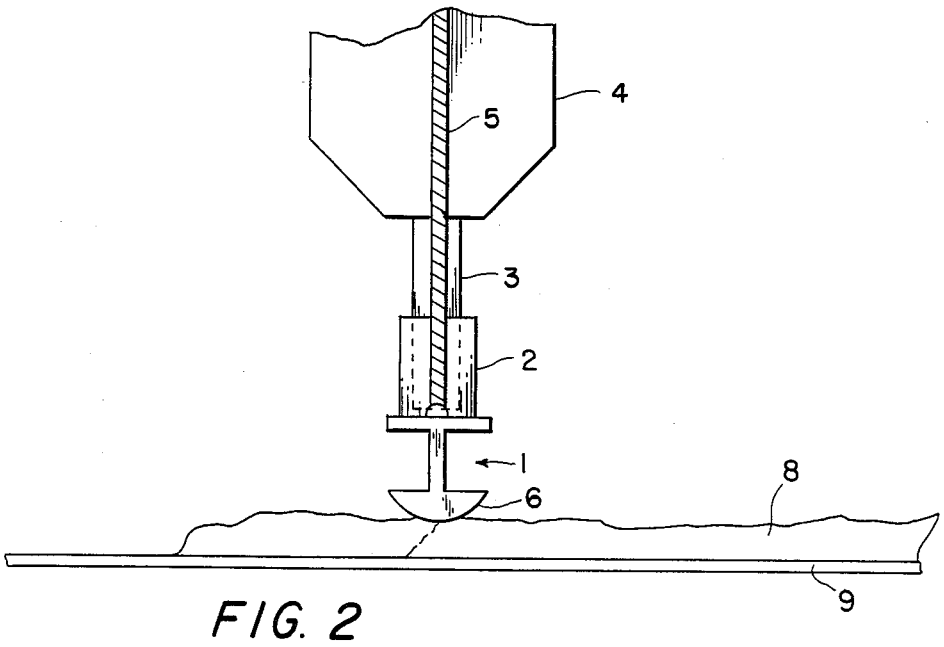
FIG. 2 is a side view of FIG. 1 including the ice and paved surface upon which the ice breaker would be used.

The bottom surface 6 of the beam 1 has a convex shape as in FIG. 2. This aids in avoiding damage to the paved surface 9.

Figure 3:
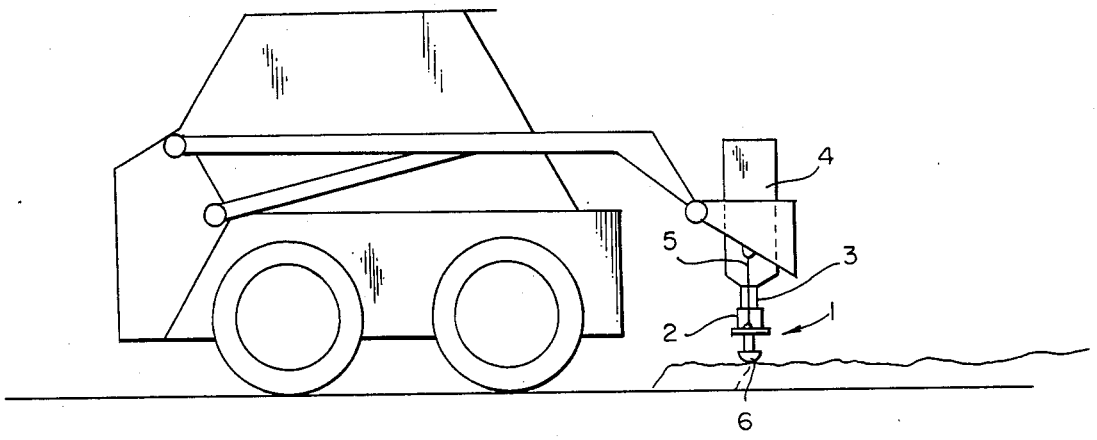
Figure 4:
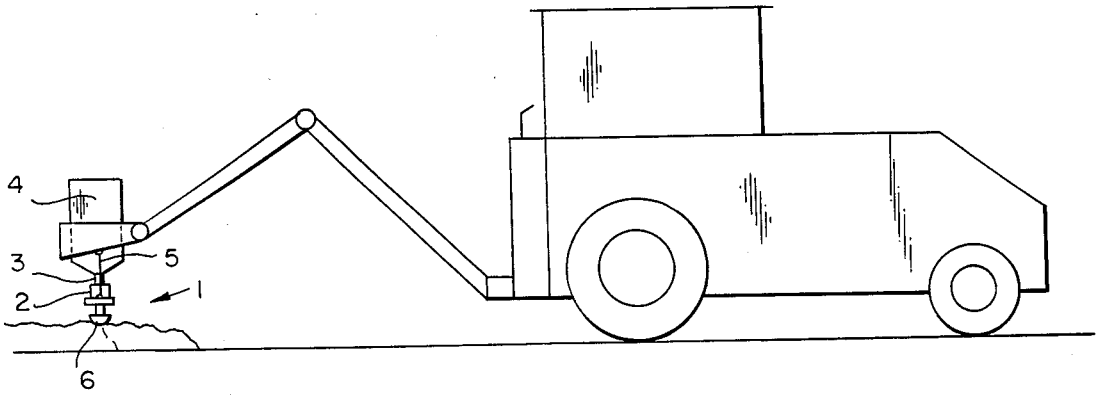

The combination of ice breaker and impact hammer can be mounted on equipment such as a skid loader FIG. 3, or backhoe FIG. 4, or may be used on a hand held impact hammer.

The unit is placed on the ice surface FIGS. 2, 3, 4 near an edge of the ice buildup. As the impact hammer is engaged, the breaker beam transfers the blows to the ice, fracturing and breaking it up. As the beam engages the tough paved surface below, the blows are distributed to such a degree that no damage is done to the paved surface. The unit is then raised and moved to another spot on the ice surface. This can be done quite rapidly, especially when the unit is mounted on equipment such as a skid loader FIG. 3. This process is repeated until all the ice is broken free of the desired surface area and then it can easily be cleared away.

I claim as my invention:

1. A method of removing accumulated ice from paved surfaces without damaging the underlying paved surface consisting essentially of the steps of:

(a) Impacting a metal beam at its center;

(b) Using the beam to transfer the blows to accumulated ice to fracture and break the ice;

(c) Using the beam to distribute the blows over a large enough area on the pavement to prevent damage to the pavement;

(d) Providing a convex bottom edge on the beam to prevent chipping the pavement;

(e) Providing a means of attaching the beam to an impacting device.

2. An ice breaker apparatus to be used in conjunction with an impact hammer for removing accumulated ice from paved surfaces, without damaging the underlying paved surface consisting essentially of:

(a) A rigid metal beam of a length that will transfer blows from an impact hammer to fracture and break up ice but will distribute those blows sufficiently to prevent damage to the more rugged underlying paved surface;

(b) A convex striking surface on the bottom of the beam to help prevent chipping the pavement;

(c) Tether cables and a vertical sleeve centered on the beam to provide a means of attaching the beam to an impact hammer.

* * * * *